US006826886B1

(12) United States Patent
Auman

(10) Patent No.: US 6,826,886 B1
(45) Date of Patent: Dec. 7, 2004

(54) CAPITAL FOR ARCHITECTURAL COLUMN

(76) Inventor: Barney J. Auman, 20 Canyon Cove, Logan, UT (US) 84321

( * ) Notice: Subject to any disclaimer, the term of this patent is extended or adjusted under 35 U.S.C. 154(b) by 0 days.

(21) Appl. No.: 09/628,830

(22) Filed: Jul. 31, 2000

(51) Int. Cl.[7] ..... E04C 3/30

(52) U.S. Cl. ..... 52/736.1; 52/2.21; 52/731.1; 52/300

(58) Field of Search ..... 52/736.1, 736.3, 52/737.1, 737.4, 2.21, 300, 301, DIG. 10, 731.1; D25/126, 127, 128, 129, 130; 47/44

(56) References Cited

U.S. PATENT DOCUMENTS

| | | | | | |
|---|---|---|---|---|---|
| 1,350,686 | A | * | 8/1920 | Trudelle | 52/301 |
| D278,676 | S | * | 5/1985 | DeAre | D7/73 |
| 4,641,467 | A | * | 2/1987 | Dupuis, Jr. | 52/297 |
| 4,912,901 | A | * | 4/1990 | Jerry | 52/301 |
| 5,117,852 | A | * | 6/1992 | Bryant | 135/104 |
| D352,787 | S | * | 11/1994 | Hulse | D25/6 |
| D376,248 | S | * | 12/1996 | Erwin | D25/126 |
| 5,987,828 | A | * | 11/1999 | Hardy | 52/295 |
| D433,162 | S | * | 10/2000 | Sandlin | D25/126 |
| D442,161 | S | * | 5/2001 | Altamura | D25/126 |
| D443,094 | S | * | 5/2001 | Landefeld | D26/68 |

* cited by examiner

*Primary Examiner*—Carl D. Friedman
*Assistant Examiner*—Chi Q. Nguyen
(74) *Attorney, Agent, or Firm*—Fehr Law Firm; Thompson E. Fehr

(57) ABSTRACT

A capital to be placed upon a hollow column having a non-uniform cross section with a maximum inner dimension and a minimum inner dimension. The capital has an ornamental upper portion attached to a neck. The neck possesses a maximum outer cross-sectional dimension which is intermediate in size between the maximum inner cross-sectional dimension of the portion of the column intended to be occupied by the neck and the minimum inner cross-sectional dimension of the portion of the column intended to be occupied by said neck. The neck also has a minimum outer cross-sectional dimension smaller than the minimum inner cross-sectional dimension of the portion of the column intended to be occupied by said neck. The neck is inserted into the column so that its maximum outer cross-sectional dimension is not aligned with the minimum inner cross-sectional dimension of the column and then twisted generally to align the maximum outer cross-sectional dimension of the neck with the minimum inner cross-sectional dimension of the column. Optionally, a shim can be used with a neck the maximum outer cross-sectional dimension of which is smaller than the minimum inner cross-sectional dimension of the portion of the column intended to be occupied by the neck.

10 Claims, 10 Drawing Sheets

CAPITAL FOR ARCHITECTURAL COLUMN

BACKGROUND OF THE INVENTION

1. Field of the Invention

This invention relates to a capital having a neck that facilitates the positioning of the capital upon a hollow architectural column and secures such capital in place on the column.

2. Description of the Related Art

The inventor is unaware of any patents for capitals associated with architectural columns.

Architectural columns are often made hollow. The capital, which is placed upon the column traditionally has had a neck that fits into the top of the hollow column. Screws are placed through the column and into the neck in order to secure the capital to the column.

The cross-sectional shape of the column is intended to be circular. The outer diameter of an architectural column is generally consistent; the inner diameter, however, often varies. Thus, the outer diameter of the neck of the capital, which neck also has a circular cross section, has had to be smaller than the minimum inner diameter anywhere within the portion of the column that is intended to be occupied by the neck of the capital; and the screws had had to be used to adjust the neck so the capital will be generally centered over the column.

SUMMARY OF THE INVENTION

The present invention involves a capital having a neck the maximum outer cross-sectional dimension of which is smaller than the maximum inner cross-sectional dimension of the portion of the hollow column intended to be occupied by the neck but larger than the minimum inner cross-sectional dimension of the portion of the column intended to be occupied by the neck. The minimum outer cross-sectional dimension of the neck must be smaller than the minimum inner cross-sectional dimension of the portion of the column intended to be occupied by the neck.

The neck is oriented so that its maximum outer cross-sectional dimension is not aligned with the minimum inner cross-sectional dimension of the portion of the column intended to be occupied by the neck and inserted within the column. The neck is then twisted generally to align the maximum outer cross-sectional dimension of the neck with the minimum inner cross-sectional dimension of the column.

Frictional forces then tend to hold the capital in place on the column; and since, the maximum outer cross-sectional dimension of the neck will be generally aligned with the minimum inner cross-sectional dimension of the column, the capital, which is attached to the top of the neck, will tend to be centered over the column.

Alternatively, rather than having maximum outer cross-sectional dimension of the neck larger than the minimum inner cross-sectional dimension of the portion of the column intended to be occupied by the neck, a shim can be placed adjacent to a neck having a maximum outer cross-sectional dimension smaller than the minimum inner cross-sectional dimension of the portion of the column intended to be occupied by the neck. The shim would be of such a thickness that, when added to the maximum outer cross-sectional dimension of the neck, the total distance would be larger than the minimum inner cross-sectional dimension of the portion of the column intended to be occupied by the neck but smaller than the maximum inner cross-sectional dimension of the portion of the column intended to be occupied by the neck.

Of course, with either option, i.e., with our without the shim, the difference between the maximum outer cross-sectional dimension of the neck and the minimum inner cross-sectional dimension of the portion of the column intended to be occupied by the neck must be small enough to permit the neck to be twisted to attain general alignment of the maximum outer cross-sectional dimension of the neck with the minimum inner cross-sectional dimension of the column.

DESCRIPTION OF THE PREFERRED EMBODIMENT

Figure 1:
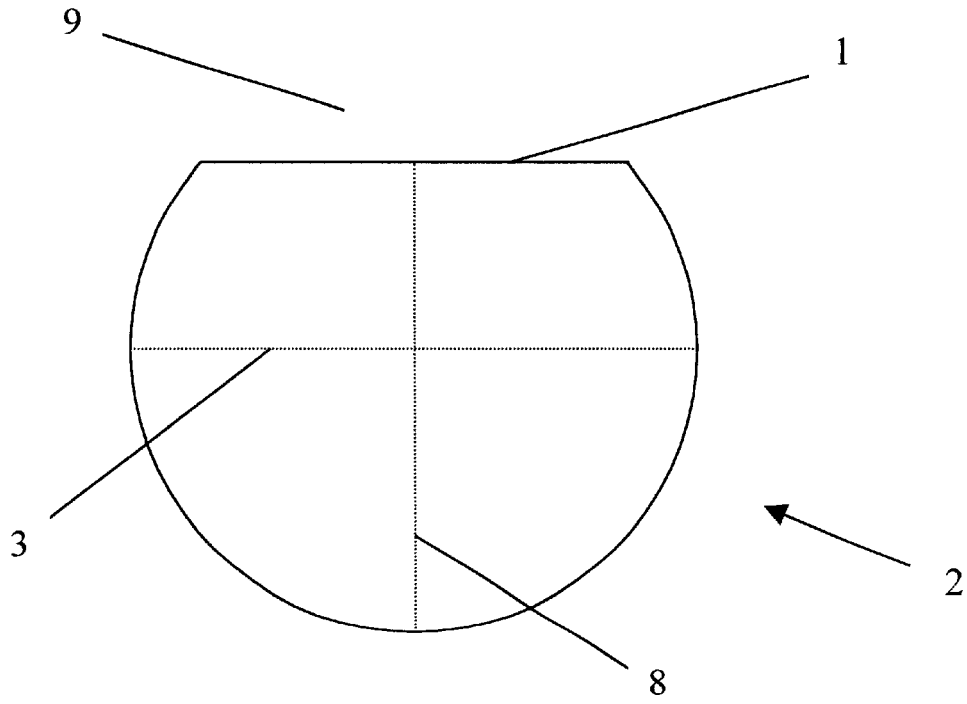
FIG. 1 depicts a cross section of the neck of a capital that is generally circular but lacks a segment.

A number of ways exist to create a capital 1 having a neck 2 the maximum outer cross-sectional dimension 3 of which is smaller than the maximum inner cross-sectional dimension 4 of the portion of a hollow column 5 intended to be occupied by the neck 2 but larger than the minimum inner cross-sectional dimension 6 of the portion 7 of the column 5 intended to be occupied by the neck 2 and having the minimum outer cross-sectional dimension 8 of the neck 2 smaller than the minimum inner cross-sectional dimension 6 of the portion 7 of the column 5 intended to be occupied by the neck 2.

Preferably, the cross section of the neck 2 is, as depicted in FIG. 1, generally circular but lacking a segment 9 (Of course, with respect to any embodiment, the structure will be initially created without any portion that is stated to be lacking, although it would be possible to create the structure with such portion but subsequently to eliminate it.) on a first side 10 to create the requisite dimensions.

Other examples of a neck 2 having the requisite dimensions are constructed as described below.

Figure 2:
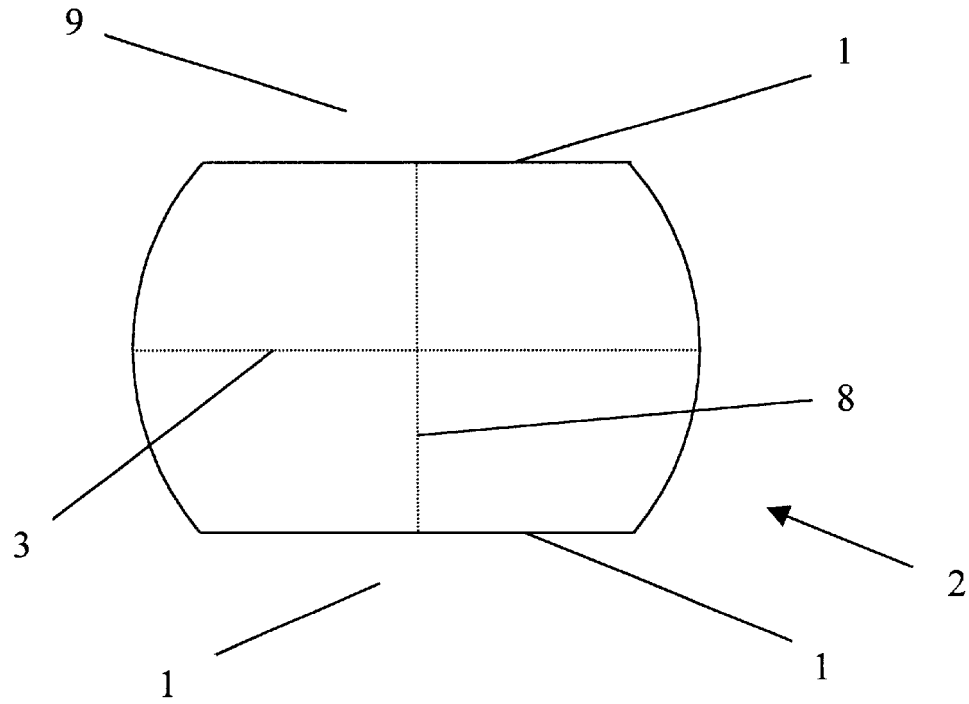
FIG. 2 illustrates a neck of a capital having a generally circular cross section but lacking a segment on a first side and a second segment on a second side of the neck that is generally opposite to the first side of the neck.

In a first option, as illustrated in FIG. 2, both the segment 9 on the first side 10 and a second segment 11 on a second side 12 of the neck 2 generally opposite to the first side 10 of the neck 2 are lacking.

Figure 3:
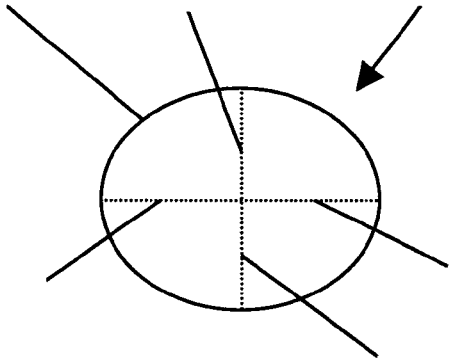
FIG. 3 shows a neck of a capital cross-sectionally shaped as an ellipse.

A second option, shown in FIG. 3, has the neck 2 cross-sectionally shaped as an ellipse 13 with the maximum outer cross-sectional dimension 3 of the neck 2 being the length of the major axis 14 of the ellipse 13 and the minimum outer cross-sectional dimension 8 of the neck 2 being the length of the minor axis 15 of the ellipse 13.

Figure 4:
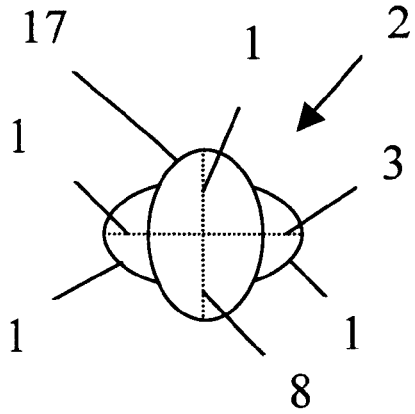
FIG. 4 demonstrates a neck of a capital with the cross section of the neck created by orienting two ellipses with their major axes generally perpendicular to one another.

A third exemplary option, portrayed in FIG. 4, is a structure created by orienting two ellipses 16, 17 with their major axes 18, 19 generally perpendicular to one another with the first ellipse 16 having its major axis 18 the length for the maximum outer cross-sectional dimension 3 of the neck 2 and the other ellipse 17 having its major axis 19 the length for the minimum outer cross-sectional dimension 8 of the neck 2.

Figure 5:
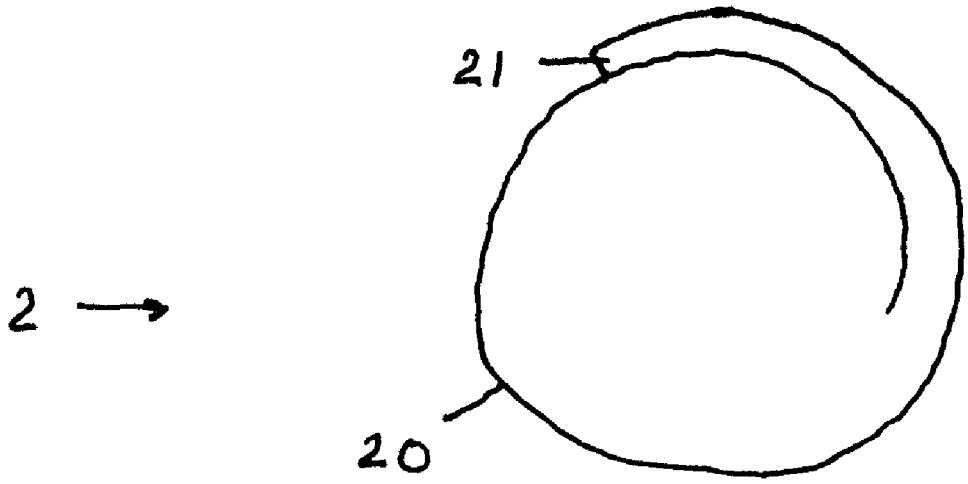
FIG. 5 portrays a neck of a capital with the cross section of the neck formed by a spiral.

A fourth option, shown in FIG. 5, is a spiral 20 where the minimum outer cross-sectional dimension 8 is attained by trimming a first end 21 of the spiral 20.

Figure 6:
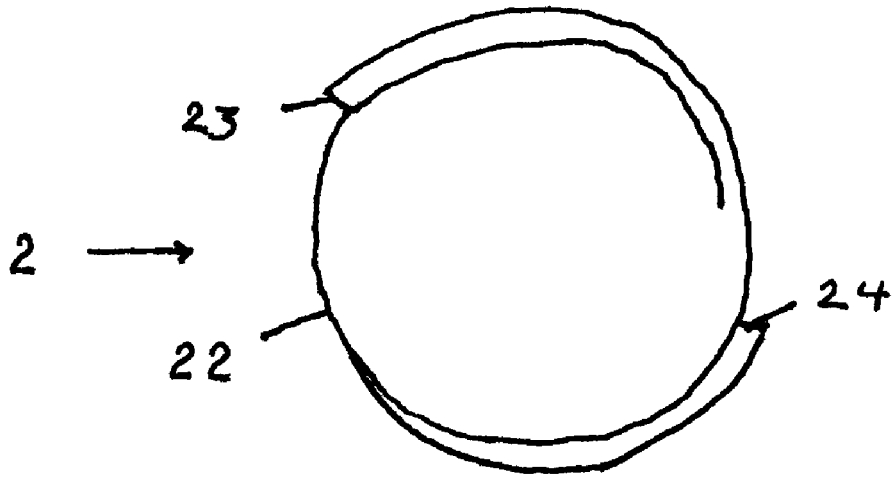
FIG. 6 depicts a neck of a capital with the cross section of the neck composed of a double spiral.

A fifth and final exemplary option, illustrated in FIG. 6, is a double spiral 22 where the minimum outer cross-sectional dimension 8 is achieved by trimming both a first end 23 and a second end 24 of the spiral 22.

Figure 7:
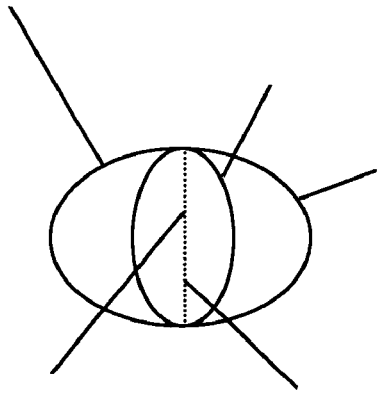
FIG. 7 shows a cross sectional view of a column into which the neck of a capital has been inserted with the maximum outer cross-sectional dimension of the neck generally aligned with the minimum inner cross-sectional dimension of the column.

Of course with any embodiment, the difference between the maximum outer cross-sectional dimension 3 of the neck 2 and the minimum inner cross-sectional dimension 6 of the portion 7 of the column 5 intended to be occupied by the neck 2 must be small enough to permit the neck 2 to be twisted to attain general alignment of the maximum outer cross-sectional dimension 3 of the neck 2 with the minimum inner cross-sectional dimension 6 of the column 5, as portrayed in FIG. 7.

Figure 8:
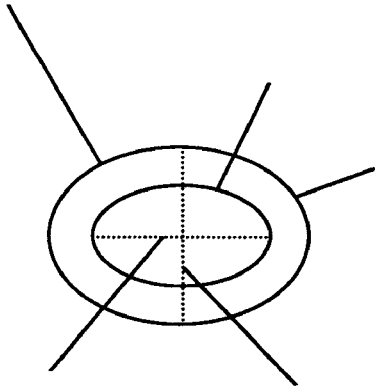
FIG. 8 illustrates a cross sectional view of a column into which the neck of a capital has been inserted with the maximum outer cross-sectional dimension of the neck not aligned with the minimum inner cross-sectional dimension of the column.

As explained above, the neck 2 of the capital 1 is initially inserted into the column 5 with the neck oriented so that its maximum outer cross-sectional dimension 3 is not aligned with the minimum inner cross-sectional dimension 6 of the portion 7 of the column 5 intended to be occupied by the neck 2, as illustrated in FIG. 8. The neck 2 is then twisted generally to align the maximum outer cross-sectional dimension 3 of the neck 2 with the minimum inner cross-sectional dimension 6 of the column 5, as shown in FIG. 7.

Figure 9:
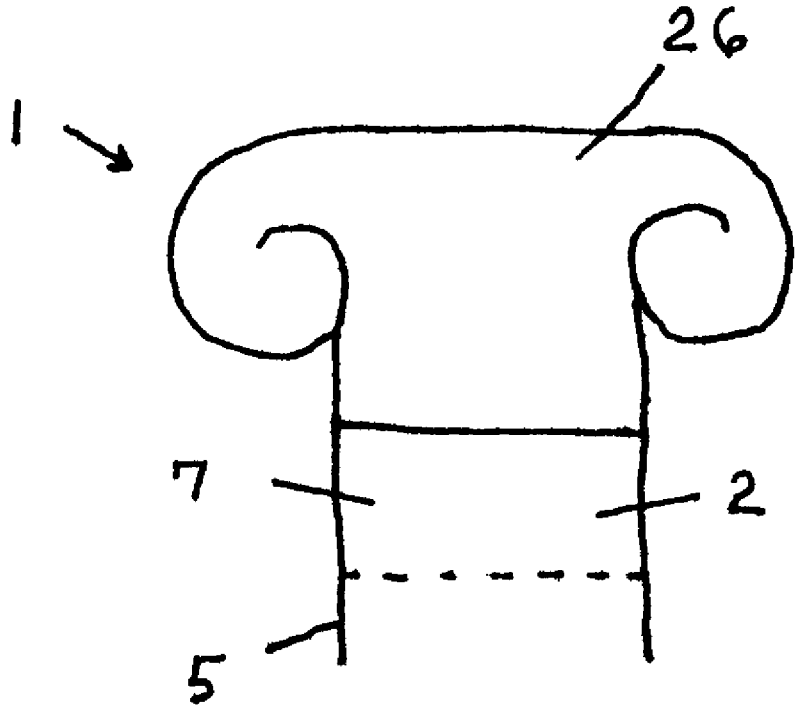
FIG. 9 illustrates an upper portion of a capital centered over a column.

As state above, frictional forces then tend to hold the capital 1 in place on the column 5; and since, the maximum outer cross-sectional dimension 3 of the neck 2 will be generally aligned with the minimum inner cross-sectional dimension 6 of the column 5, the upper portion of the capital 1, of which the neck 2 constitutes the lower portion, will tend to be centered over the column 5, as portrayed in FIG. 9.

If desired, however, screws can also placed through the column 5 and into the neck 2 in order to secure the capital 1 to the column 5.

Figure 10:
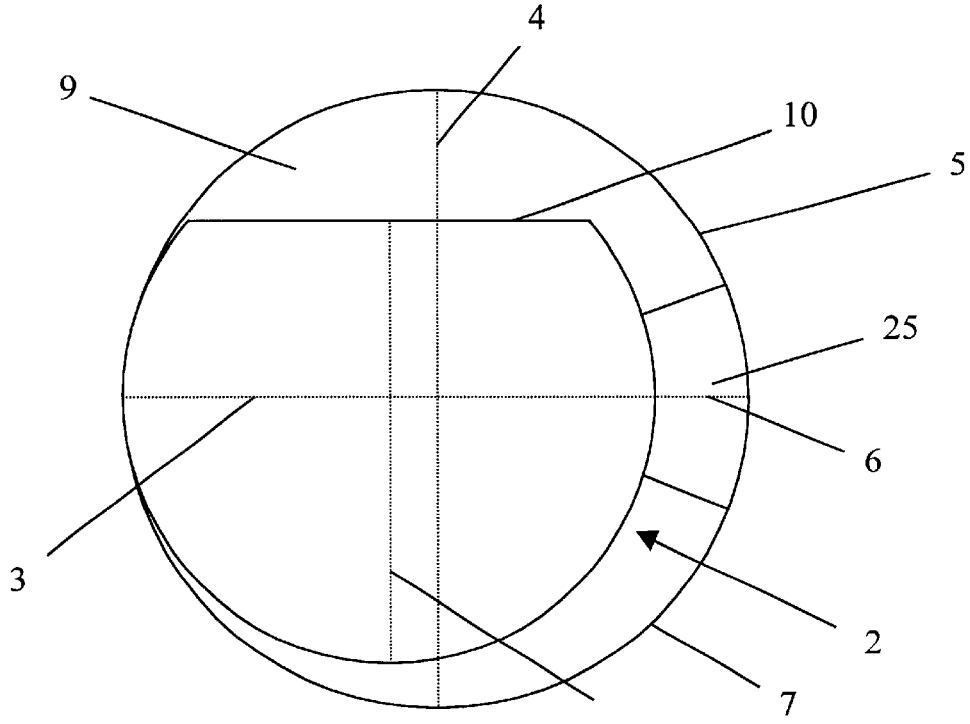
FIG. 10 provides a cross-sectional view of a neck of a capital and a shim adjacent to the neck inserted into a column.
Figure 11:
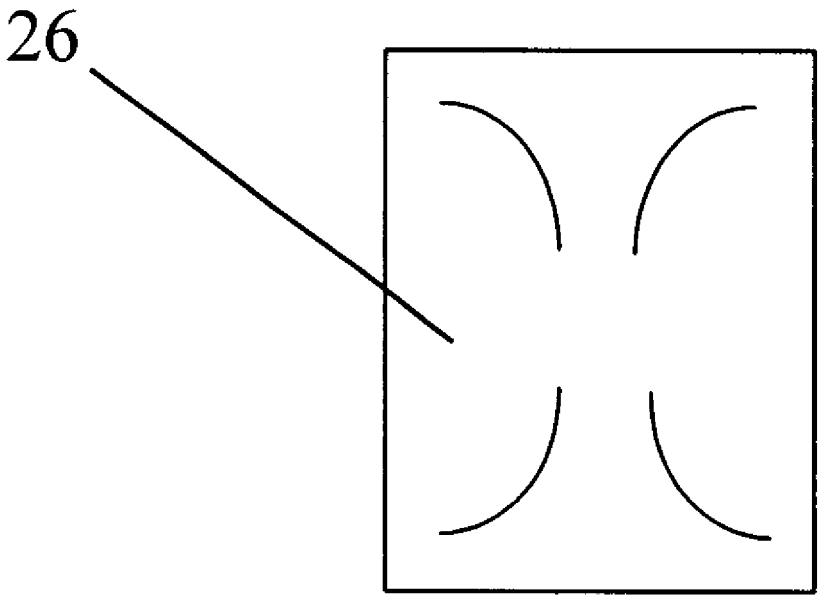
FIG. 11 is a plan view of the ornamental upper portion of a capital on a column.
Figure 12:
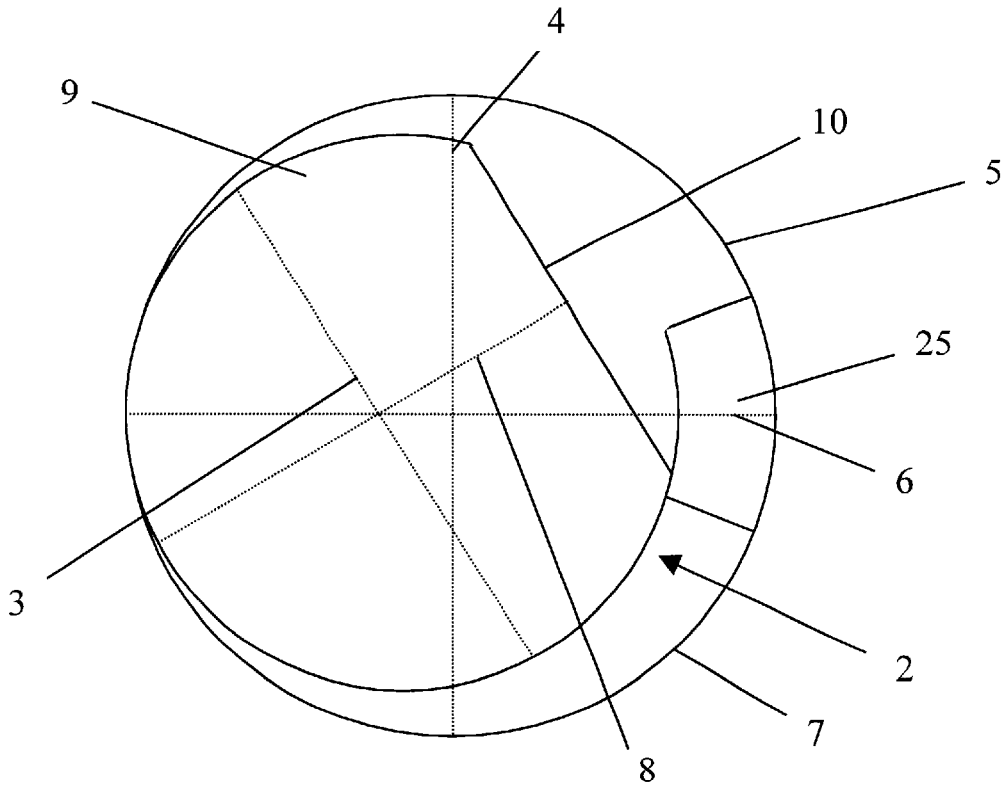
FIG. 12 shows the embodiment of FIG. 10 with the neck of the capital at a different angular orientation with respect to the column intended to be occupied by the neck of the capital.
Figure 13:
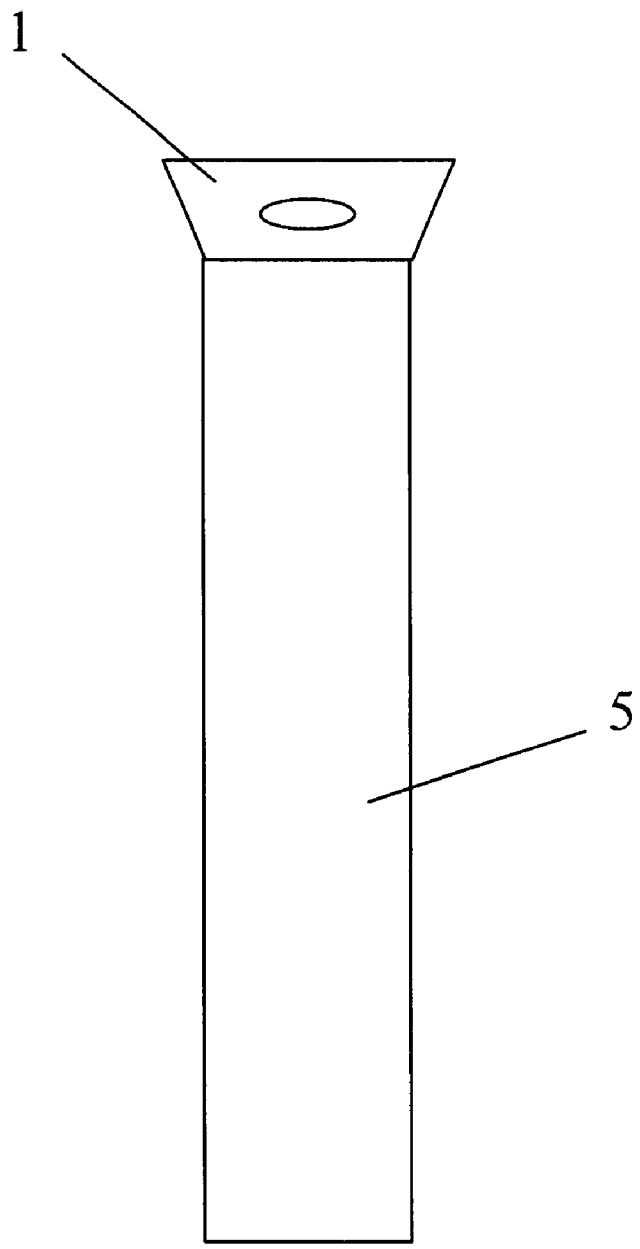
FIG. 13 illustrates a whole view of a column and a capital ornament utilized together.

Alternatively, as explained above, rather than having the maximum outer cross-sectional dimension 3 of the neck 2 larger than the minimum inner cross-sectional dimension 6 of the portion 7 of the column 5 intended to be occupied by the neck 2, a shim 25 can be placed, as shown in FIG. 10, adjacent to a neck 2 having a maximum outer cross-sectional dimension 3 smaller than the minimum inner cross-sectional dimension 6 of the portion 7 of the column 5 intended to be occupied by the neck 2. The shim 25 is of such a thickness that, when added to the maximum outer cross-sectional dimension of the neck 3, the total distance is larger than the minimum inner cross-sectional dimension 6 of the portion 7 of the column 5 intended to be occupied by the neck 2 but smaller than the maximum inner cross-sectional dimension 4 of the portion 7 of the column 5 intended to be occupied by the neck 2. The shim 25 is so located that when the neck 2 is twisted substantially to align the maximum outer cross-sectional dimension 3 of the neck 2 with the minimum inner cross-sectional dimension 6 of the column 5.

And similarly to the discussion above, the difference between the maximum outer cross-sectional dimension 3 of the neck 2 combined with the thickness of the shim and the minimum inner cross-sectional dimension 6 of the portion 7 of the column 5 intended to be occupied by the neck 2 must be small enough to permit the neck 2 to be twisted to attain general alignment of the maximum outer cross-sectional dimension 3 of the neck 2 with the minimum inner cross-sectional dimension 6 of the column 5, as portrayed in FIG. 7.

Additionally, in any embodiment, the capital 1 has an ornamental upper portion 26 attached to the neck 2. The ornamental upper portion 26 will be visible when the capital 1 has been installed upon a column 5.

I claim:

1. In combination of a column and a capital, which column having a non-uniform cross section with a maximum inner dimension and a minimum inner dimension, comprising: a column; a capital, which comprising an ornamental upper portion; and a neck attached to said ornamental upper portion inserted within a portion of said column, said neck having a cross section with a maximum outer cross-sectional dimension which is smaller than a maximum inner cross-sectional dimension of a portion of said column inserted by said neck but larger than the minimum inner cross-sectional dimension of the portion of said column occupied by said neck, a minimum outer cross-sectional dimension smaller than a minimum inner cross-sectional dimension of the portion of said column occupied by said neck, and the difference between the maximum outer cross-sectional dimension of said neck and the minimum inner cross-sectional dimension of the portion of said column inserted by said neck is small enough to permit said neck to be twisted to attain general alignment of the maximum outer cross-sectional dimension of said neck with the minimum inner cross-sectional dimension of said column.

2. The capital to be placed upon a hollow column having a nonuniform cross section with a maximum inner dimension and a minimum inner dimension as recited in claim 1, wherein:

the cross section of said neck is generally circle having a first side but lacking a segment on the first side.

3. The capital to be placed upon a hollow column having a nonuniform cross section with a maximum inner dimension and a minimum inner dimension as recited in claim 1, wherein:

the cross section of said neck is generally circle having a first side and a second side generally opposite to the first side but lacking a segment on the first side and a second segment on the second side.

4. The capital to be placed upon a hollow column having a nonuniform cross section with a maximum inner dimension and a minimum inner dimension as recited in claim 1, wherein:

the cross section of said neck is shaped as an ellipse with the maximum outer cross-sectional dimension of said neck being the length of the major axis of the ellipse and the minimum outer cross-sectional dimension of the neck being the length of the minor axis of the ellipse.

5. The capital to be placed upon a hollow column having a nonuniform cross section with a maximum inner dimension and a minimum inner dimension as recited in claim 1, wherein:

the cross section of said neck comprises a first ellipse having a major axis the length of which is the maximum outer cross-sectional dimension of said neck and a second ellipse attached to the first ellipse and having a major axis the length of which is the minimum outer cross-sectional dimension of said neck.

6. The capital to be placed upon a hollow column having a nonuniform cross section with a maximum inner dimension and a minimum inner dimension as recited in claim 1, wherein:

the cross section of said neck is a spiral having a first end that is trimmed to create the minimum outer cross-sectional dimension of said neck.

7. The capital to be placed upon a hollow column having a nonuniform cross section with a maximum inner dimension and a minimum inner dimension as recited in claim 1, wherein:

the cross section of said neck is a double spiral having a first end and a second end that are trimmed to create the minimum outer cross-sectional dimension of said neck.

8. In combination of a column and a capital, which column having a non-uniform cross section with a maximum inner dimension and a minimum inner dimension, comprising: a column; a capital, which comprising a column;

an ornamental upper portion;

a shim; and a neck attached to said ornamental upper portion, adjacent to said shim, and inserted within a portion of said column with said shim ultimately being adjacent to a portion of said column having the maximum inner dimension, said neck having a cross section with a maximum outer cross-sectional dimension smaller than a minimum inner cross-sectional dimension of the portion of said column occupied by said neck, a maximum outer cross-sectional dimension that, when added to the thickness of said shim, has a total distance larger than the minimum inner cross-sectional dimension of the portion of said column occupied by said neck but smaller than a maximum inner cross-sectional dimension of the portion of said column occupied by said neck, and the difference between the maximum outer cross-sectional dimension of said neck combined with the thickness of said shim and the minimum inner cross-sectional dimension of the portion of the column occupied by said neck is small enough to permit said neck to be twisted to attain general alignment of the maximum outer cross-sectional dimension of said neck with the minimum inner cross-sectional dimension of the column.

9. A process for securing a capital upon a hollow column having a non-uniform cross section with a maximum inner dimension and a minimum inner dimension, which comprises:

orienting a neck of a capital, such neck having a cross section with a maximum outer cross-sectional dimension which is smaller than the maximum inner cross-sectional dimension of a portion of a column intended to be occupied by said neck but larger than the minimum inner cross-sectional dimension of the portion of the column intended to be occupied by said neck, a minimum outer cross-sectional dimension smaller than the minimum inner cross-sectional dimension of the portion of the column intended to be occupied by said neck, and the difference between the maximum outer cross-sectional dimension of said neck and the minimum inner cross-sectional dimension of the portion of the column intended to be occupied by said neck is small enough to permit said neck to be twisted to attain general alignment of the maximum outer cross-sectional dimension of said neck with the minimum inner cross-sectional dimension of the column, so that the maximum outer cross-sectional dimension of such neck is not aligned with the minimum inner cross-sectional dimension of the portion of the column intended to be occupied by the neck, inserting the neck into the column, and then twisting the neck until the maximum outer cross-sectional dimension of the neck is generally aligned with the minimum inner cross-sectional dimension of the column.

10. A process for securing a capital upon a hollow column having a non-uniform cross section with a maximum inner dimension and a minimum inner dimension, which comprises:

placing a shim adjacent to a neck of a capital, such neck having a cross section with a maximum outer cross-sectional dimension smaller than a minimum inner cross-sectional dimension of a portion of a column intended to be occupied by said neck, a maximum outer cross-sectional dimension that, when added to the thickness of said shim, has a total distance larger than the minimum inner cross-sectional dimension of the portion of the column intended to be occupied by said neck but smaller than a maximum inner cross-sectional dimension of the portion of the column intended to be occupied by said neck, and the difference between the maximum outer cross-sectional dimension of said neck combined with the thickness of said shim and the minimum inner cross-sectional dimension of the portion of the column intended to be occupied by said neck is small enough to permit said neck to be twisted to attain general alignment of the maximum outer cross-sectional dimension of said neck with the minimum inner cross-sectional dimension of the column, orienting the neck of the capital so that the maximum outer cross-sectional dimension of such neck is not aligned with the minimum inner cross-sectional dimension of the portion of the column intended to be occupied by the neck, inserting the neck and the shim into the column, then twisting the neck until the maximum outer cross-sectional dimension of the neck is generally aligned with the minimum inner cross-sectional dimension of the column, and placing the shim so that said shim is adjacent to a portion of the column having the maximum inner dimension of the neck has been twisted.

* * * * *